US006073434A

United States Patent [19]

Amos

[11] Patent Number: 6,073,434

[45] Date of Patent: Jun. 13, 2000

[54] MULTIPLE YARN END PNEUMATIC SPLICER

[75] Inventor: Cathy N. Amos, Rocky Face, Ga.

[73] Assignee: Williams Specialty Company, Dalton, Ga.

[21] Appl. No.: 09/472,297

[22] Filed: Dec. 27, 1999

[51] Int. Cl.[7] ..... D01H 15/00

[52] U.S. Cl. ..... 57/22; 28/209

[58] Field of Search ..... 57/22, 23, 202, 57/350, 261, 263; 28/209, 210, 211, 141, 271, 274

[56] References Cited

U.S. PATENT DOCUMENTS

| | | | |
|---|---|---|---|
| 1,523,999 | 1/1925 | Hathaway | 28/209 |
| 2,956,328 | 10/1960 | Faw | 28/210 |
| 3,695,975 | 10/1972 | Williams | 156/502 |
| 4,538,407 | 9/1985 | Matsui et al. | 57/22 |
| 4,788,814 | 12/1988 | Crouch et al. | 57/22 |
| 4,833,872 | 5/1989 | Czelusniak, Jr. et al. | 57/22 |
| 5,003,676 | 4/1991 | McFalls | 28/209 |
| 5,032,214 | 7/1991 | Kile | 156/502 |
| 5,297,323 | 3/1994 | Jaeggi | 28/211 |
| 5,357,740 | 10/1994 | Moreland | 57/22 |

*Primary Examiner*—Amy B. Vanatta
*Attorney, Agent, or Firm*—Alan Ruderman; Miller & Martin LLP

[57] ABSTRACT

An apparatus for joining together a plurality of sets of ends of yarn includes a housing having a plurality of splicing bores communicating with at least one passageway which selectively communicates with a pressurized fluid source. A set, preferably a pair, of yarns are placed in each splicing bore. A cutting member is utilized to cut the yams while within the bore so there are two yarn ends to be joined within the bore. The pressurized fluid source is then placed into communication with the bore and the splicing process begins. The yarns may be moved relative to the axis of the bore during the splicing process with a wiping bar. The pressurized fluid source may then be selectively removed from communication with the splicing bore to complete the splicing process. The sets of yarn will then preferably be represented as continuous strands of yarn entangled, intertwined, and/or twisted at the splice joints.

18 Claims, 3 Drawing Sheets

MULTIPLE YARN END PNEUMATIC SPLICER

BACKGROUND OF THE INVENTION

This invention relates to apparatus for joining together the ends of a multiplicity of yarns with the ends of another respective multiplicity of yarns substantially simultaneously to form the yarns into respective continuous strands of yarns utilizing air to entangle, intertwine or twist the yarn pairs together, and more particularly to apparatus having a multiplicity of splicing chambers each for receiving and splicing together a pair of yarn ends by air supplied under pressure to all of the chambers from the same source.

In order to join one yarn end to another, such as the yarn end at the end of a first yarn cone and the yarn end at the beginning of a second yarn cone so that a continuous length of yarn may be fed to various textile machines, such as a tufting machine forming carpet pile, the art has developed two basic types of yarn splicers. One of these splicers operates by using heat to join the ends of thermoplastic yarn and the other operates by air entanglement whereby air under pressure is applied to a chamber in which the pair of yarn ends are disposed to entangle the fibers at the ends of the yarn and join the yarn ends together.

Although there are several heat splicers known in the prior art wherein a multiplicity of thermoplastic yarn ends may be spliced together, the known air entanglement splicers are hand-held units that only splice two yarn ends together at a time. For example, in U.S. Pat. No. 3,695,975, a moveable heat splicing unit is disclosed which moves transversely across the yarns to be spliced to make successive splices, while U.S. Pat. No. 5,032,214 moves a heating element into engagement with a multiplicity of yarn ends at the same time to splice the yarn ends substantially simultaneously. In air entanglement splicers, on the other hand, the known apparatus are hand-held units such as those disclosed in U.S. Pat. Nos. 5,357,740; 4,825,630; 4,833,872; 4,788,814; 4,538,407 and 3,572,025 which are hand-held splicers of the type under consideration.

One of the problems in developing an air entanglement splicer is that all of the yarn ends must be cut and thereafter joined. In heat splicing apparatus, this is not the case since the cutting and joining of the yarn ends occurs as the heat melts the yam ends while joining them together. Of course, it must be understood, that only thermoplastic yams which effectively melt and bond together may be spliced using heat splicing techniques. Additionally, with air entanglement twisted cabled filament yarn, especially polypropylene, and air entangled yam, a hand technique may be required including a wiping action to pull the yarns slowly out of the air entanglement chamber under a finger of the user.

SUMMARY OF THE INVENTION

Consequently, it is the primary object of the present invention to provide a pneumatic splicer for joining together a multiplicity of pairs of yam ends.

It is another object of the present invention to provide apparatus for severing the ends of a multiplicity of pairs of yarns and joining the severed yarn ends together by entangling the ends pneumatically.

It is a further object of the present invention to provide a multiple yarn end pneumatic splicer wherein pairs of yarn ends may be severed and joined by entanglement, and wherein the yarn ends may be wiped across the outlet of the air entanglement chamber.

Accordingly, the present invention provides an elongated housing having a multiplicity of splicing chambers into each of which a pair of yarn ends to be spliced together are placed, each chamber having at least one air inlet extending into the chamber for directing air from a high pressure source to entangle together the yarn fibers of each yarn end to join the yarn end pairs together, the housing supporting a moveable knife bar carrying a multiplicity of cutting members for severing the pairs of yarn ends so that each pair may be joined properly without knots. The housing further supports a moveable wiping bar to pull or wipe the yarns across the yarn outlet of the chambers while air is flowing into the chambers so as to create somewhat of a seal at the end of the chamber as the yarn is wiped to strengthen the splice.

The cutting members of the knife bar comprise knives which preferably have a throat formed between a pair of cutting edges and the yam ends are severed in the respective throat. The surface of the wiping bar that faces the chamber and contacts the yarn strands is an elastomeric material that grips the yarn strands and wipes them as the wiping bar is moved.

BRIEF DESCRIPTION OF THE DRAWINGS

The particular features and advantages of the invention as well as other objects will become apparent from the following description taken in connection with the accompanying drawings in which.

DESCRIPTION OF PREFERRED EMBODIMENT

Figure 1:
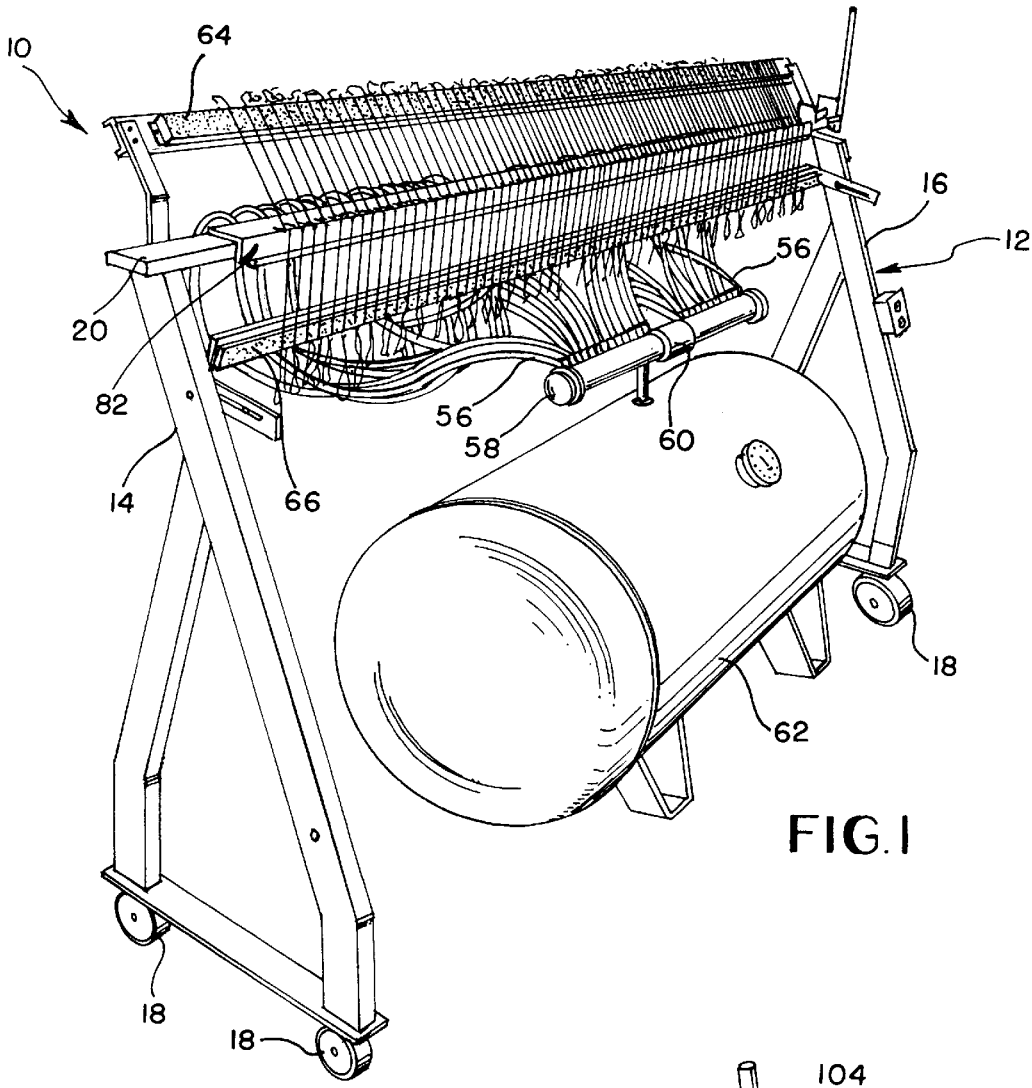
FIG. 1 is a perspective view of a multiple yarn end pneumatic splicer apparatus constructed in accordance with the principles of the present invention.

Referring to the drawings, a preferred form of the splicing apparatus 10 of the present invention is illustrated as being supported on a frame 12 which may include a pair of spaced apart standards 14, 16 mounted on caster wheels 18. Spanning the standards, 14, 16 is a splicing chamber housing 20 which comprises a substantially rectangular bar having a multiplicity of spaced apart splicing chambers 22 best illustrated in FIGS. 3 and 4 received within cooperating bores in the housing 20. Each splicing chamber 22 comprises a metal barrel of substantially cylindrical form with a bore 24 extending from a first or upper end 26 to the second or lower end 28 as illustrated. Opening into the bore 24 is an to elongated slot 30 substantially parallel to the axis of the bore extending at the periphery from the upper end 26 to the lower end 28 and having inclined wall surfaces 32, 34 tapering from the outer periphery of the splicing chamber inwardly toward the bore 24 a short distance into the main portion of the slot 30. The inclined surfaces 32, 34 act as guides for directing a pair of yams into the slot 30 and thus into the central cavity defined by the bore 24.

Figure 8:
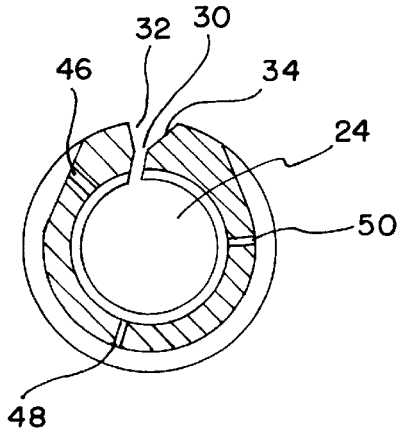
FIG. 8 is a cross-sectional view taken substantially through the splicing chamber transverse to the axis.

The lower end 28 of each splicing chamber 22 has a recess or slightly undercut step portion 36 at a location remote from the slot 30 and spaced from the axis of the bore 24, the undercut portion acting against a land 38 in the housing 20 to position and located the respective splicing chamber in the housing. Disposed between the ends 26, 28 of each splicing chamber is a respective peripheral recess 40 extending about the central portion of the chamber axially inwardly a small distance from both ends 26, 28, the recess 40 extending a small distance from one of the inclined surfaces 32 to a small distance from the other of the inclined surfaces 34. Extending from the surface 32 to the surface 34 adjacent to the recess 40 and to each end 26, 28 is a respective groove receiving a respective seal 42, 44, the seals each being in the form of a larger section of an "O" ring. The seals not only function as seals for air that is fed to the recess 40, as hereinafter made clear, but also aid in securing the splicing chambers within the cooperative bores of the housing 20. Extending from the surface of the recesses 40 into the bore 24 is one and preferably three small bores 46, 48, 50 best illustrated in FIG. 8 for reasons which hereinafter will be understood.

Figure 3:
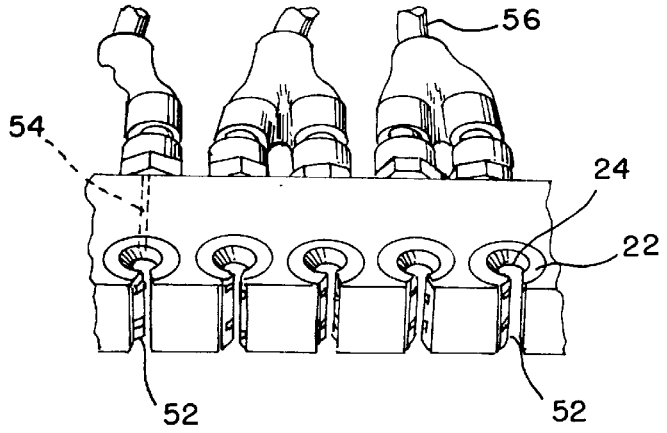
FIG. 3 is a perspective view of a fragment of the splicing chamber mounting housing.

The housing 20 has a multiplicity of slots 52 equal in number to the number of splicing chambers, each slot 52 being aligned with a respective slot 30 of the splicing chambers. Additionally, the cavity 40 of each splicing chamber 22 communicates through a respective bore 54 in the housing 20 with one end of a conduit or pneumatic line 56, there being one pneumatic line 56 for each two splicing chambers 22 in the preferred embodiment as illustrated in FIG. 3, albeit one or more than two lines per splicing chamber may be utilized. The other ends of the pneumatic lines 56 are connected to a manifold 58 which receives high pressure air through a valve assembly 60 from a supply tank 62 or directly from a shop air supply. When the valve is actuated, air flows through the line 56 to the respective splicing chamber 22 via the bores 54. The air then flows about the recess 40 between the seals 42, 44, enters the bores 44, 48, 50 and is directed into the larger bore 24 where it swirls about in a turbulent spiral course. As it does this with a pair of yarn ends within the bore 24, the ends of the yarn will normally break up into strands permitting the yarn to be spliced together as the strands of the first yarn end are intertwined or twisted together with the strands of the other yarn end.

It should be clear that for the yarn ends to be properly positioned within the bores 24 to be spliced together, the ends of the yarn should be held in position and severed so that the ends of each pair of yarn ends may be intertwined and twisted. Thus, the yarn should be held in place and severed while within the bores 24 of the splicing chamber 22.

To this end the frame 12 carries upper and lower yarn holders 64, 66 respectively. Each of the yarn holders comprises an elongated rod or block having a multiplicity of metal wires extending from the surface thereof, the wires acting to hold each yarn end in place therebetween. In lieu of an upper yarn holder of this construction it may be a clamping mechanism so once spliced the ends may simply be unclamped and fall freely back toward the housing. Moreover, a cutting bar 68 in the form of an elongated bar having a multiplicity of slots or openings 70 is disposed beneath the splicing chamber housing 20 and carried on a number of headed pegs 72 extending from beneath the housing, each peg being received within a respective elongated slot 74, only one of which is illustrated. This permits the cutting bar 68 to slide in the longitudinal direction an amount obviously determined by the length of the slot 74. Of course, rather than the slot 74 and peg 72 for supporting the bar 68 for sliding, the bar may be positioned on a plate or the like supported from the housing 20 so that the bar 68 may slide on the plate.

Figure 2:
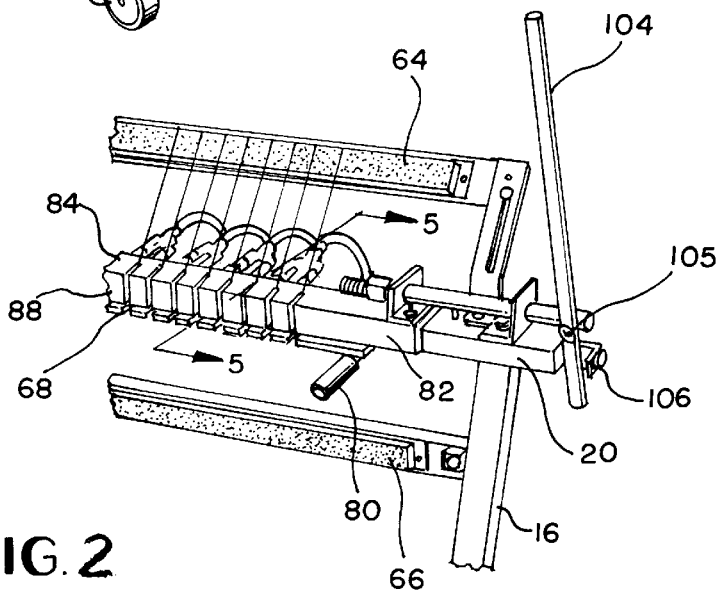
FIG. 2 is a fragmentary perspective view of the apparatus illustrated in FIG. 1 looking from the opposite end of FIG. 1.

The cutting bar 68 has a pair of straight edge cutting blades 76, 78 disposed with the cutting edges forming a Vee therebetween and with each Vee disposed over a respective opening 70. The bar may be slid manually by means of a handle 80 secured to the bar preferably adjacent one end thereof which is moved so that the slots 74 move relative to the pegs 72. The openings 70 in the normal position are disposed below the respective slots 52 in the splicing chamber housing 20. When yarn strands are disposed within the respective opening 70 and within the Vee formed by the knives, they are severed by the knife cutting edges. Thus, two yarn strands received within each opening 70 are severed by the blades when the handle 80 is moved to the left as illustrated in FIG. 2. Moreover, rather than the cutting bar 68, a single rotary cutting system may suffice.

Figure 4:
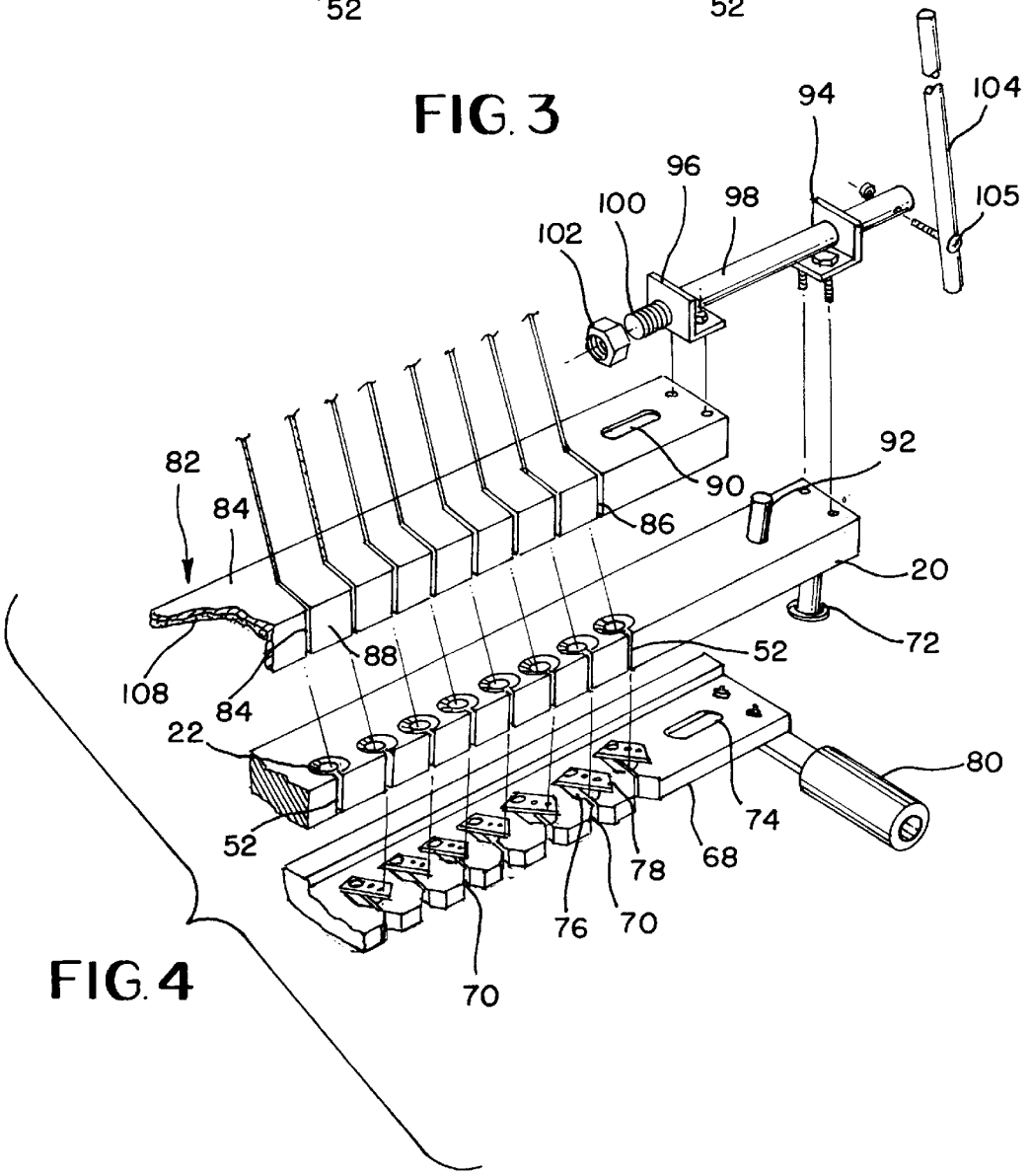
FIG. 4 is an exploded view illustrating the disposition of the splicer chamber mounting housing, the cutting bar and the wiping bar.
Figure 5:
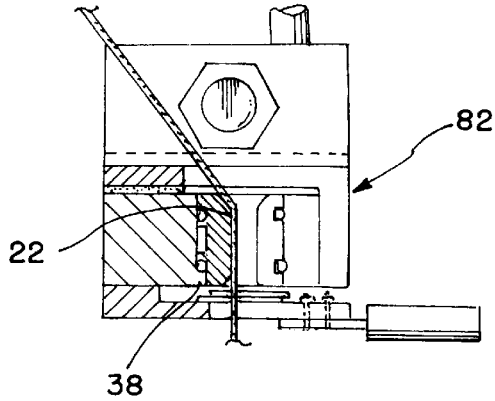
FIG. 5 is a cross-sectional view taken substantially along line 5—5 of FIG. 2.
Figure 6:
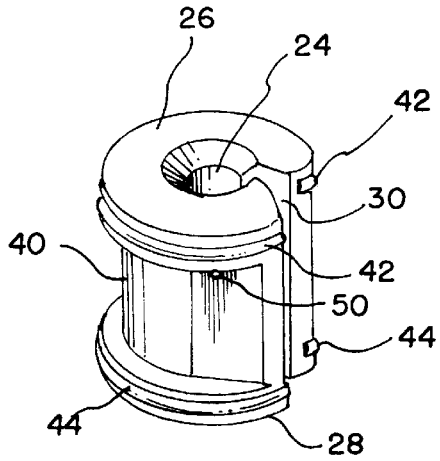
FIG. 6 is a perspective view of a splicing chamber as seen from the upper end.
Figure 7:
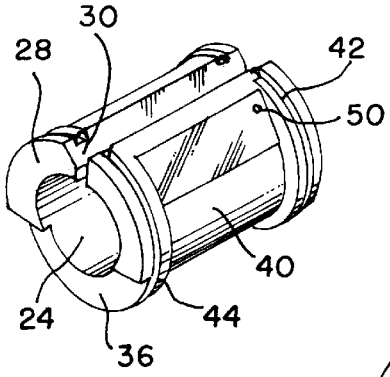
FIG. 7 is a perspective view of a splicing chamber illustrating the opposite end of FIG. 6.

As aforesaid, certain yarn such as polypropylene may require a wiping action of the pair of yams to be joined after the air splicing has occurred. To this end the present invention incorporates a wiping bar 82 having a substantially L-shaped cross-sectional configuration, as best illustrated in FIG. 4, one leg 84 of which is disposed on the housing 20 as illustrated in FIG. 2. The wiping bar 82 has a multiplicity of slots 86 in the other leg 88 spaced apart the same distance as the slots 52 in the housing 20 and includes a plurality of elongated slots 90 (only one of which is illustrated) in the leg 84 for receiving respective pegs 92.

Secured to the housing 20 is a first bracket 94 while a second bracket 96 is secured to the wiping bar 82. A rod 98 is received through a bore in the bracket 94 while only one threaded end 100 of the rod passes through a bore in the bracket 96, a nut 102 being secured to the end of the rod 98. Thus, when the rod 98 moves laterally the bracket 96 and thereby the wiping bar 82 moves with it. A lever 104 is pivotally connected adjacent one end by a pin 105 to the end of the rod remote from the threaded end 100 and is disposed adjacent the corresponding end of the housing 20. Another bracket 106 secured to the housing 20 has a leg spaced slightly from the end of the housing 20 to trap or sandwich the lever 104 in the small space between the end of the housing 20 and the bracket intermediate the pivot pin 105 and the adjacent end of the lever. Thus, when the lever 104 is pivotally moved toward and away from the wiping bar 82, the wiping bar moves in the longitudinal direction relative to the housing 20. In the normal position the wiping bar is disposed with the slots 86 superposed over the slots 52 and the openings 70. As illustrated in FIG. 4, the lower or under surface of the leg 84 of the wiping bar is coated with an elastomeric material 108 so that when the wiping bar is moved, the elastomeric material grips, moves or wipes yarn extending out of the splicing chambers with it. This tightens the splice and insures a strong connection.

In use, a multiplicity of pairs of yarns to be spliced together are drawn over the upper yarn holder 64, through the respective slots 86 in the wiping bar 82 and thus the slots 52 in the housing 20 and the opening 70 in the cutting bar 68 and placed in the wires in the lower yarn holder 66. The handle 80 is then moved to sever the yarns so that there are two severed yarns within the cavities adjacent the lower end. Air is then valved to the splicing chambers and the ends of each pair of yarns is spliced or joined together. Thereafter, the wiping bar is shifted to tighten the splice.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed therein is:

1. A yarn splicer for splicing multiple sets of yam together comprising:

a housing having at least one passageway for receiving pressurized fluid and carrying a plurality of yarn chambers, each yarn chamber having a first end, a second end and a splicing bore defined by an interior wall of said chamber intermediate said first and second ends and communicating with said at least one passageway, each bore having a substantially central axis, the axes of said bores being substantially parallel to one another, each of said chambers having a slot communicating the bore with the exterior of said chamber for receipt of yarn into said bore, a cutting member including at least one knife movable relative to said housing for severing yam ends proximate to at least two of said splicing bores, and a pressurized fluid source selectively connected to said at least one passageway to splice together sets of yams in each chamber.

2. The yarn splicer as recited in claim 1 further comprising at least one valve located intermediate said at least one passageway and said pressurized fluid source, said at least one valve providing selective communication between said pressurized fluid source and said at least one passageway.

3. The yarn splicer as recited in claim 1 wherein the axes of said bores are arranged in a substantially linear arrangement relative to one another.

4. The yarn splicer as recited in claim 1 wherein the cutting member is supported in a knife bar, said knife bar extending substantially adjacent to and along at least a portion of said housing.

5. The yarn splicer as recited in claim 4 wherein the knife bar is moveable relative to the housing.

6. The yarn splicer as recited in claim 5, wherein said knife bar includes a plurality of knives, a pair of knives associated with each bore, the knives of each pair being mounted to form a cutting throat therebetween.

7. The yarn splicer as recited in claim 1 further comprising a wiping bar for moving at least one of said pair of yarn in a direction along the axis of said splicing bore during a splicing operation, said wiping bar having a first side and a second side, said second side of said wiping bar located proximate to and moveable relative to the housing.

8. The yarn splicer as recited in claim 7 wherein said wiping bar contains a plurality of connecting passages allowing at least one of said multiple sets of yarn to extend therethrough into at least two of said plurality of splicing bores.

9. The yarn splicer as recited in claim 8 further comprising wiping slots communicating the connecting passages with an exterior of the wiping bar for receipt of yarn into said connecting passages.

10. The yarn splicer as recited in claim 9 wherein the wiping bar has a first position relative to the housing wherein said wiping slots are substantially aligned with said slots of said chamber.

11. The yarn splicer as recited in claim 8 wherein the second side of said wiping bar further comprises a texturized surface.

12. A yarn splicer for splicing multiple sets of yarn together comprising:

a housing having at least one passageway for receiving pressurized fluid and carrying a plurality of yarn chambers, each yarn chamber having a first end, a second end and a splicing bore defined by an interior wall of said chamber intermediate said first and second ends and communicating with said at least one passageway, each bore having a substantially central axis, the axes of said bores being substantially parallel to one another, each of said chambers having a slot communicating the bore with the exterior of said chamber for receipt of yarn into said bore, a wiping bar for moving at least one of said sets of yarn in a direction along the axis of said splicing bore during a splicing operation, said wiping bar having a first side and a second side, said second side of said wiping bar located proximate to and moveable relative to the housing, and a pressurized fluid source selectively connected to said at least one passageway to splice together sets of yarns in each chamber.

13. The yarn splicer as recited in claim 12 wherein the second side of the wiping bar further comprises a texturized surface.

14. The yarn splicer of claim 12 further comprising a frame supporting said housing and said wiping bar.

15. The yarn splicer as recited in claim 12 further comprising a cutting member including at least one knife movable relative to said housing for severing yarn ends in at least two of said splicing bores.

16. The yarn splicer as recited in claim 12 wherein the cutting member is supported in a knife bar, said knife bar extending substantially adjacent to and along at least a portion of said housing.

17. The yarn splicer as recited in claim 16 wherein the knife bar is moveable relative to the housing.

18. The yarn splicer as recited in claim 17, wherein said knife bar includes a plurality of knives, a pair of knives associated with each bore, the knives of each pair being mounted to form a cutting throat therebetween.

* * * * *

UNITED STATES PATENT AND TRADEMARK OFFICE

CERTIFICATE OF CORRECTION

PATENT NO. : 6,073,434
DATED : June 13, 2000
INVENTOR(S) : Amos, et al.

It is certified that error appears in the above-identified patent and that said Letters Patent is hereby corrected as shown below:

Name of Inventors should be Cathy N. Amos, Bernard O. Bird, Barney L. Cochran and Charles F. McDaniel as filed in the Declaration filed with the application papers.

Signed and Sealed this

First Day of May, 2001

*Attest:*

Nicholas P. Godici

NICHOLAS P. GODICI

*Attesting Officer*

*Acting Director of the United States Patent and Trademark Office*